United States Patent [19]

Tanzer

[11] Patent Number: 5,029,389

[45] Date of Patent: Jul. 9, 1991

[54] METHOD OF MAKING A HEAT PIPE WITH IMPROVED END CAP

[75] Inventor: Herbert J. Tanzer, Topanga, Calif.

[73] Assignee: Hughes Aircraft Company, Los Angeles, Calif.

[21] Appl. No.: 132,850

[22] Filed: Dec. 14, 1987

[51] Int. Cl.[5] ..... B23P 15/26

[52] U.S. Cl. ..... 29/890.32; 29/422; 165/104.21; 165/104.26

[58] Field of Search ..... 29/157.3 H, 157.3 R, 29/422, 157.4, 890.032; 165/104.21, 104.26

[56] References Cited

U.S. PATENT DOCUMENTS

| | | | |
|---|---|---|---|
| 3,680,189 | 8/1972 | Noren . | |
| 3,769,674 | 11/1973 | Droughton et al. | 29/157.3 H |
| 4,018,269 | 4/1977 | Honda et al. | 29/157.3 H X |
| 4,353,415 | 10/1982 | Klaschka et al. | 29/157.3 H X |

FOREIGN PATENT DOCUMENTS

| | | | |
|---|---|---|---|
| 0158749 | 12/1979 | Japan | 29/157.3 H |
| 0068584 | 5/1980 | Japan | 29/157.3 H |
| 0136091 | 8/1982 | Japan | 29/157.3 H |
| 59-89997 | 5/1984 | Japan . | |

*Primary Examiner*—Irene Cuda

*Attorney, Agent, or Firm*—Terje Gudmestad; W. K. Denson-Low

[57] ABSTRACT

A method of purging and sealing a heat pipe includes brazing an end cap to the end of a heat pipe. The end cap has a hole therethrough, through which the heat pipe is charged. After charging, the heat pipe can be sealed simply by pinching the end cap to cold weld the hole shut, and at the same time any excess portion of the end cap can be severed off. Using this process the end cap takes up less of the condensor zone, providing for more efficient heat exchange. Additionally, the seal is more reliable.

14 Claims, 2 Drawing Sheets

METHOD OF MAKING A HEAT PIPE WITH IMPROVED END CAP

BACKGROUND OF THE INVENTION

1. Field of the Invention

The present invention relates in general to heat pipes and, more particularly, to a method of sealing a heat pipe.

2. Description of Related Art

With the ever-increasing density and high power of electronic components, e.g., memories and logic arrays in high speed computers, the problem of heat generation by electronic components in close proximity to one another on electronic circuit cards has become of increasing concern to industry. In response, over the past several years heat pipes have been developed to cool electronic circuit cards. Typically, a number of heat pipes are formed and placed into a metal substrate which is bonded to a circuit card. In its conventional form, a heat pipe is a closed tube or chamber of various shapes whose inner surfaces are lined with a porous capillary wick. The wick is saturated with a working fluid. The heat pipe has an evaporator section where the heat pipe absorbs heat, and also has a condensor section where heat is released to a heat sink in contact with that section of the pipe. In operation, heat absorbed by the evaporator section causes liquid to evaporate from the wick. The resultant vapor is transferred within the tube to the condensor section of the heat pipe where it condenses releasing the heat of vaporization to a heat sink. The capilliary action of the wick pumps the condensed liquid back to the evaporator section for reevaporation. The process will continue as long as working fluid is contained within the heat pipe.

However, too often the liquid in the heat pipe chamber is lost due to a break in the heat pipe seal. The ability to reliably and effectively seal heat pipes has been sought by the industry for many years, because if the fluid within the heat pipe is lost due to a leak in the heat pipe the equipment cooled by the heat pipe could be subject to great heat damage. Several means of sealing heat pipes have evolved over the last couple of years.

In one conventional arrangement, for example, a heat pipe includes a hollow tube with end caps inserted into each end of the tube. One end cap has a hole therethrough with a copper pinchoff tube brazed to the hole. The heat pipe is purged and filled with the proper working fluid using the copper tube. To seal the heat pipe the copper tube is pinched shut using a roller pinch off tool. See, for example, Dunn & Reay, *Heat Pipes* 154 (3rd Ed. 1982). However, the rollers of the pinch off tool get close to the braze and may crack the braze during pinch off. Additionally, after being sealed the fragile copper tube protrudes outwardly a short distance from the end cap, and therefore is very susceptible to breakage and consequently loss of fluid. In order to adequately protect this protruding copper tube, a cover must be placed over the end cap and copper tube. The end cap cover and copper tube disadvantageously consumes a large portion of the condenser section at the end of the heat pipe. Both reliability and efficiency of the heat pipe fabricated by this technique are limited.

In an attempt to improve upon this design, the copper tube has been attached directly to the side of the heat pipe tube instead of to the end cap. A copper tube is welded to a hole within the side of the heat pipe tube, and the heat pipe tube chamber is purged and filled with working fluid using this copper tube. After filling the heat pipe with fluid the copper tube is pinched shut to seal the tube. As with the above described process, the braze can be cracked during pinch off. Furthermore, this sealing technique is disadvantageous in that a portion of the copper tube extends outwardly from the side of the heat pipe. In this arrangement the fragile copper tube has no cover and is very susceptible to breakage. Additionally, the placement of the copper pinchoff tube on the side of the heat pipe tube hampers expulsion of noncondensable gases during purging. Furthermore, because the copper tube protrudes outwardly from the side of the heat pipe, heat pipes formed by this technique cannot be placed adjacent to each other.

Consequently, there is a need in the industry for a means of sealing a heat pipe which is economically accomplished and provides a strong and reliable seal.

SUMMARY OF THE INVENTION

It is therefore an object of the present invention to provide a more reliable technique of sealing a heat pipe tube.

It is a further object of the present invention to provide a heat pipe with improved heat transfer characteristics.

It is still a further object of the present invention to provide a heat pipe which is more easily sealed.

It is an advantage of the present invention that it provides a heat pipe with more available area for the condenser.

It is a further advantage of the present invention that it provides improved purging of noncondensable gases.

It is a feature of the present invention in that a one piece end cap can be used to both fill and provide a seal for a heat pipe.

A method for sealing a heat pipe according to the present invention includes providing an elongated hollow pipe with an opening at one end and also providing an end cap with a hole therethrough. A wick is inserted into the tube, and the end cap is brazed into the open end of the elongated hollow pipe. Thereafter, the pipe is filled with a working fluid. To seal the heat pipe, the end cap is plastically squeezed, thereby closing the hole and sealing the heat pipe.

DETAILED DESCRIPTION

Figure 1A:
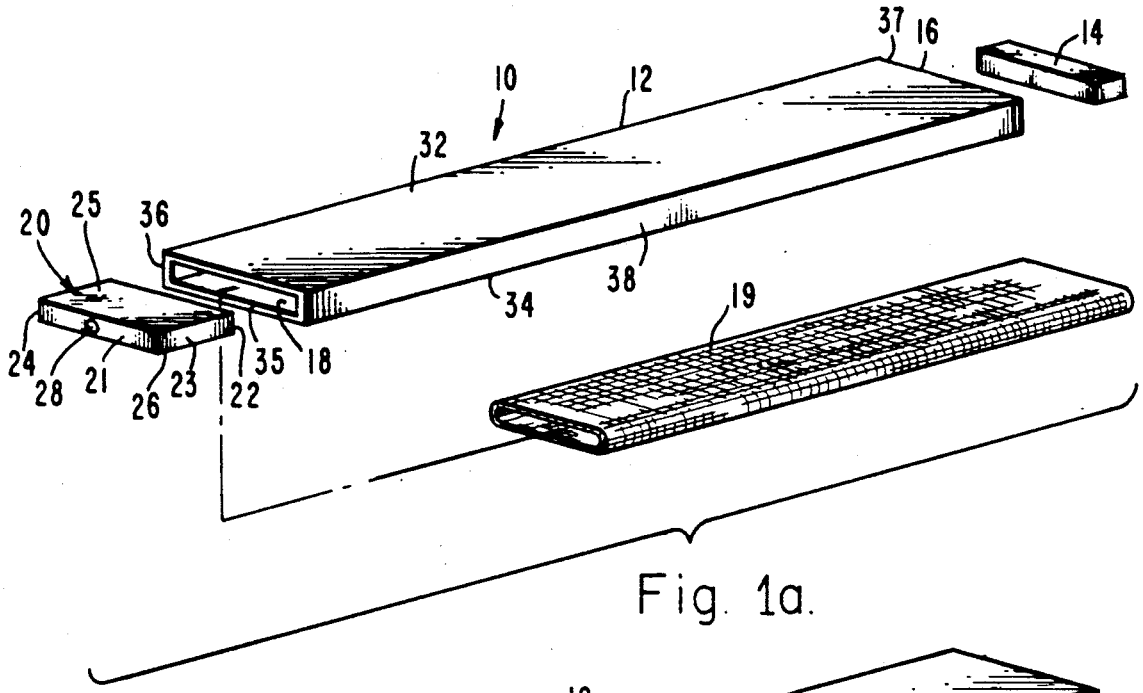
FIG. 1*a–c* are perspective views of a heat pipe being assembled and sealed at various stages of fabrication according to a preferred embodiment of the invention.

Referring to FIG. 1*a* with greater particularity, a heat pipe 10 is shown including a flat elongated hollow pipe 12 made of good thermally conductive material such as monel or copper. The elongated pipe 12 may be a rectangular pipe or a flattened round tube having a hole therethrough, the walls of the elongated pipe being about 10–12 mils thick, for example. An elongated rectangular pipe 12 is illustrated in FIG. 1*a* which has top and bottom surfaces 32 and 34, respectively, and side walls 36 and 38, all of which are essentially parallel to one another. Rectangular pipe 12 further has ends 35 and 37 which are essentially perpendicular to the top, bottom and side walls. Ends 35 and 37 have rectangularly shaped openings 18 and 16.

End cap 14 is slid into opening 16 and welded or brazed to end 37 of elongated pipe 12, thereby sealing that end. End cap 14 is typically a rectangularly shaped copper block of such dimensions that it can be slidably inserted into opening 16. Wick 19, which may be notched, is inserted into elongated pipe 12, and sits in very close contact with the inner walls of the pipe. Wick 19 may be made of a porous material such as copper felt, for example; however, other wick materials can be used which are chemically compatible with the working fluid, provide good capillary pumping capability between the condensor and evaporator and have a sufficiently high thermal conductive path between the heat pipe wall and the liquid-vapor interface.

Sealable end cap 20 may be a rectangularly shaped block of copper material having opposing end walls 21 and 22 which are essentially parallel to one another and further having top and bottom walls 25 and 26 and side walls 23 and 24 which are essentially parallel to each other but substantially perpendicular to end walls 21 and 22. Sealable end cap 20 has a hole 28 therethrough from end wall 21 to end wall 22, which hole is typically essentially parallel to the side walls 23 and 24. The top, bottom and side walls 23, 24, 25 and 26 are machined or otherwise shaped such that sealable end cap 20 can be slidably inserted into open end 18 of elongated pipe 12.

Figure 1B:
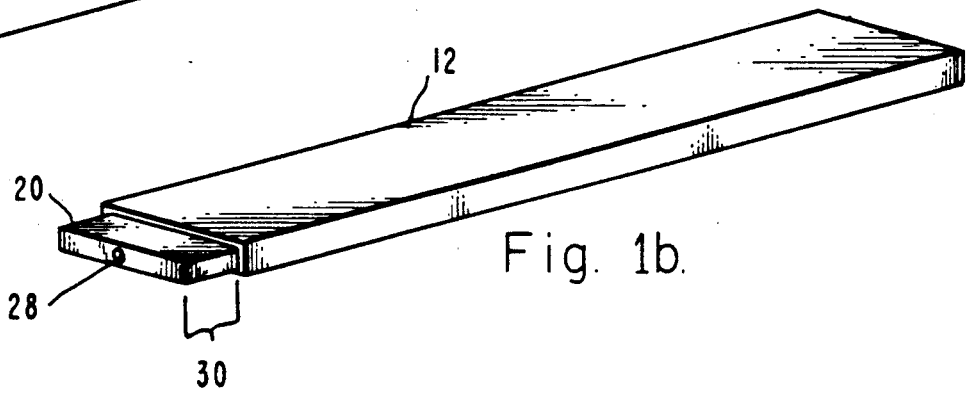

Sealable end cap 20 is slid into opening 18 of hollow pipe a short distance, typically about 0.02 to 0.03 inches, as shown in FIG. 1*b*. Sealable end cap 20 is brazed or electron beam welded into open end 18. A portion 30 of sealable end cap 20 extends out from elongated pipe 12, with hole 28 forming a passageway from the exterior of elongated pipe 12 to its interior. Accordingly, hole 28 provides access to the interior of the heat pipe so that it can be purged and filled with a suitable working fluid. Extended portion 30 of sealable end cap 20 may protrude from the end of pipe 12 about ¼ to ½ of an inch which provides sufficient length to perform the pinch off described hereinbelow.

Using hole 28, the interior of elongated pipe 12 is evacuated and filled with a working fluid (not shown). In the temperature range of from about 20° C. to 200° C. water is a good working fluid, for example. Methanol works well at low temperature ranges between about −50° C. to +50° C.

Figure 1C:
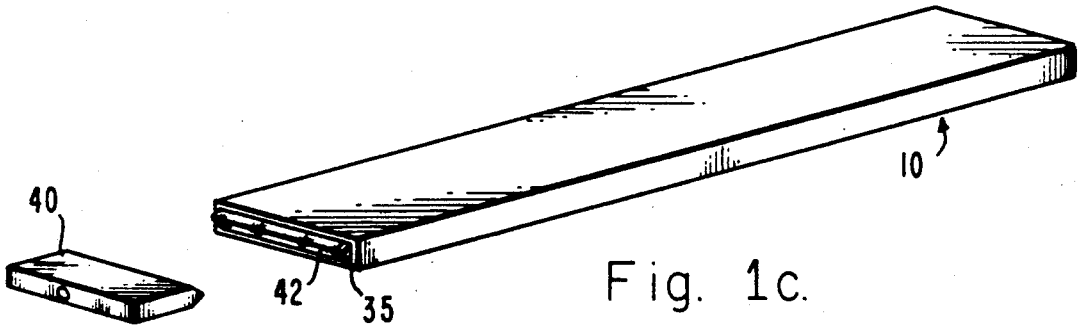

After the elongated pipe 12 has been filled with the proper working fluid, it is sealed by pinching sealable end cap 20 between a pair of rollers (not shown). The rollers are applied on top and bottom surfaces 25 and 26 to plastically squeeze the metal together therebetween, which closes hole 28 by cold welding, thereby sealing the heat pipe, and also shears off a portion 40 of sealable end cap 20; see FIG. 1*c*. A roller pinch off tool may be used to perform the sealing process, for example. A small portion 42 of sealable end cap 20 remains and extends outwardly a short distance from the end 35 of elongated pipe 12. For additional details on the manufacture of heat pipes, reference may be made to Dunn & Reay, *Heat Pipes* (3rd Ed. 1982) which is incorporated herein by reference, and serves to provide further background information and understanding as well as to suggest various details and alternatives that may be included.

Consequently, heat pipe 10 is formed having a reliable seal which is easily and cost effectively implemented. The effective condensor length of heat pipe 10 is maximized since the end cap 20 takes up only a small portion of the condensor section at the end of heat pipe 10. Typically, sealable end cap 20 can be pinched off so that the remaining small portion 42 of end cap 20 extends only about 1/16 to 1/10 of an inch outwardly from end 35 of the elongated pipe 12.

Figure 2A:
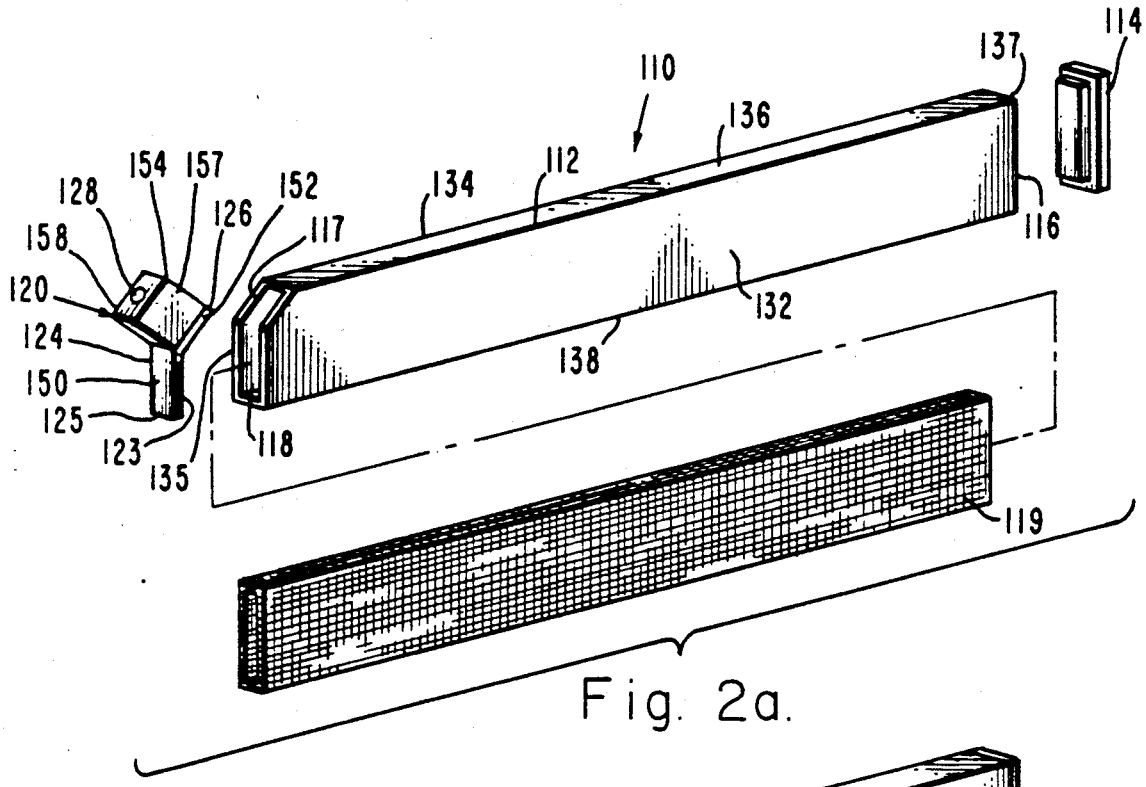
FIG. 2*a–c* are perspective views of another heat pipe being assembled and sealed at various stages of fabrication of the invention.
Figure 2B:
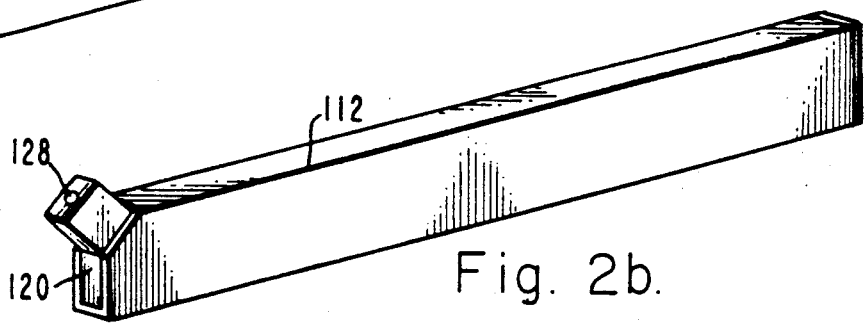
Figure 2C:
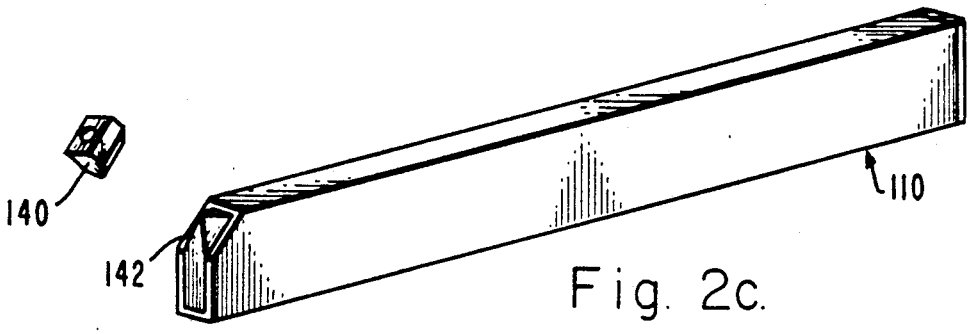

An alternative embodiment of a preferred heat pipe is illustrated in FIG. 2. Components in the embodiment of FIG. 2, which are the same as or equivalent to respective components in the embodiment of FIG. 1, are designated by the same second and third reference numeral digits as their corresponding components in FIG. 1, along with the addition of a prefix numeral "1". In FIG. 2*a*, rectangularly shaped hollow tube has top and bottom walls 132 and 134 and side walls 136 and 138 which are essentially parallel to each other. End 137 is substantially perpendicular to the top, bottom and side walls, and has a rectangular cross-section opening 116. End cap 114 is typically a rectangularly shaped block of copper material dimensioned to fit into rectangular opening 116 at end 137. Elongated tube 112, wick 119 and end cap 114 are assembled as described above with reference to FIG. 1*a*.

Opening 118 forms the other opening to elongated tube 112 at the other end 135. End 135 is essentially perpendicular to top, bottom and side walls 132, 134, 136, and 138. End 135 further has one corner cut out forming recessed end portion 117.

After elongated pipe 112, end cap 114, and wick 119 have been assembled as described above, sealable end cap 120 is slid into open end 118 of elongated pipe 112. Sealable end cap 120 is a flat rectangularly shaped piece 150 of copper material having four sides 123, 124, 124 and 126. A smaller portion of rectangularly shaped piece is bent to form a small angled portion 152 which conforms with recessed end portion 117. The four sides 123, 124, 125 and 126 of sealable end cap 120 are machined or otherwise shaped so that end cap 120 will fit snugly into opening 118. Tab 154 protrudes outwardly from angled portion 152 about ¼ to ½ inch and is typically in the shape of a rectangular block. End cap 120 has a hole 128 therethrough extending through tab 154 and angled portion 152.

Sealable end cap 120 is brazed or election beam welded to elongated pipe 112. Using hole 128, the interior of elongated pipe is evacuated and filled with a suitable working fluid. Tab 154 is thereafter pinched between two rollers to seal the heat pipe. The rollers (not shown) are applied to surfaces 157 and 158 to squeeze the copper metal together therebetween, which welds hole 128 shut and simultaneously cuts off a portion 140 of tab 154.

A heat pipe is thus described with improved means of sealing. It should be understood that although the invention has been shown and described for one particular embodiment, nevertheless various changes and modifications obvious to a person skilled in the art to which the invention pertains are deemed to lie within the spirit and scope of the invention as set forth in the following claims.

What is claimed is:

1. A method of sealing a heat pipe, comprising the steps of:

providing an elongated hollow pipe having an opening at one end;

providing a block-shaped member having two opposing surfaces and a hole passing through said member between said two opposing surfaces which provide workable surfaces for sealing said hole;

brazing said block-shaped member in said opening such that said hole forms a passageway to the inside of said elongated hollow pipe;

filling said elongated hollow pipe with working fluid through said hole; and applying compressive force on said two opposing surfaces to plastically squeeze said block-shaped member, cutting off a piece of said block-shaped member while simultaneously plastically squeezing said hole closed.

2. The method of sealing a heat pipe as defined in claim 1 wherein said block-shaped member has a block-shaped protruding tab having two opposing surfaces and said hole extending through said tab between said two opposing surfaces of said tab which provide workable surfaces for sealing said hole and said step of applying compressive force is performed on said two opposing surfaces of said tab.

3. The method of claim 2 wherein the step of applying compressive force is performed by squeezing said two opposing surfaces of said tab between two rollers.

4. The method of sealing a heat pipe as defined in claim 1 wherein the step of applying compressive force is performed by squeezing said opposing surfaces between two rollers.

5. A method of purging and sealing a pipe, comprising the steps of:

providing a pipe having an opening at one end;

providing a substantially rectangularly shaped end cap having a hole therethrough between two opposing surfaces of said end cap, said two opposing surfaces providing working surfaces for sealing said hole;

securely attaching said end cap to the opening of said pipe such that said hole provides a passageway to the inside of said pipe;

purging said pipe using said hole; and applying compressive force on said two opposing surfaces to plastically deform said end cap and seal and cut off a portion of said end cap.

6. The method of purging and sealing a pipe as defined in claim 5 wherein said end cap is attached to said pipe by brazing.

7. The method of purging and sealing a pipe as defined in claim 6 wherein said step of purging includes evacuating said pipe and filling it with a working fluid.

8. The method of purging and sealing a pipe as defined in claim 5 wherein said step of applying compressive force to plastically deform said end cap is accomplished by squeezing said and cap between two rollers.

9. The method of purging and sealing a pipe as defined in claim 5 wherein said end cap has a substantially rectangular shaped protruding tab having two opposing surfaces and said hole is located in said protruding tab essentially parallel to said opposing surfaces of said tab which provide working surfaces for sealing said hole and, said tab being plastically deformed to seal said pipe by applying said compressive force on said two opposing surfaces of said tab.

10. A method of purging and sealing a heat pipe, comprising the steps of:

providing an elongated hollow pipe having first and second openings, one at each end;

providing a first end cap;

securely attaching said first end cap to said first opening to seal said first opening;

providing a wick;

inserting said wick into said elongated hollow pipe;

providing a block-shaped second end cap having two opposing surfaces and having a hole therethrough essentially parallel to said opposing surfaces, said opposing surfaces providing working surfaces for sealing said hole;

securely attaching said second end cap to said second opening wherein said hole forms an opening to said elongated hollow pipe;

evacuating and filling said elongated hollow pipe with a working fluid through the hole in said second end cap; and applying compressive force to said two opposing surfaces to plastically squeeze said end cap to cut off a portion of said second end cap and seal the hole in said second end cap.

11. The method of purging and sealing a heat pipe as defined in claim 10 wherein said block-shaped second end cap is substantially rectangularly shaped.

12. The method of purging and sealing a heat pipe as defined in claim 11 wherein said second end cap is cut off and sealed by pinching said second end cap between two rollers.

13. The method of purging and sealing a heat pipe as defined in claim 10 wherein said second end cap has a tab, said hole passing through said tab, and the step of plastically squeezing is performed upon said tab.

14. The method of purging and sealing a heat pipe as defined in claim 13 wherein said second end cap is cut off and sealed by squeezing said tab between two rollers.

* * * * *